US005960469A

United States Patent [19]

Nuckols et al.

[11] Patent Number: 5,960,469

[45] Date of Patent: Oct. 5, 1999

[54] LIQUID-INSULATED GARMENT FOR COLD WATER DIVING

[75] Inventors: Marshall L. Nuckols, Annapolis, Md.; Richard A. Ramey, Panama City, Fla.; Billy F. Courson, Panama City Beach, Fla.; James G. Zoulias, Pensacola, Fla.

[73] Assignee: The United States of America as represented by the Secretary of the Navy, Washington, D.C.

[21] Appl. No.: 09/093,852

[22] Filed: Jun. 4, 1998

[51] Int. Cl.[6] ..... B32B 3/26; B32B 5/16; B63C 11/04

[52] U.S. Cl. ..... 2/2.1; 2/2.1 R; 2/2; 126/204

[58] Field of Search ..... 2/456, 458, 2.14, 2/2.15, 2.16, 97, 81, 82, DIG. 3; 405/185, 186; 219/211; 126/204

[56] References Cited

U.S. PATENT DOCUMENTS

| | | | |
|---|---|---|---|
| 3,348,236 | 10/1967 | Copeland | 2/2 |
| 3,449,761 | 6/1969 | Long | 2/2.1 |
| 3,513,825 | 5/1970 | Chun | 126/204 |
| 3,660,849 | 5/1972 | Jonnes et al. | 2/2.1 |
| 3,744,053 | 7/1973 | Parker et al. | 2/2.1 |
| 4,067,064 | 1/1978 | Cerniway et al. | 2/2.1 R |

*Primary Examiner*—John J. Calvert
*Assistant Examiner*—Bobby Muromoto
*Attorney, Agent, or Firm*—Harvey A. Gilbert; Donald G. Peck

[57] ABSTRACT

A liquid-insulated garment supplements the inherent thermal protection value of traditional suit insulations in conventional passive diving suits with bladders containing insulating liquids having substantially the same densities as water and thermal conductivities of less than 0.070 Btu/ft-hr° F. to provide insulation from ambient cold. The additional thermal protection created by the liquid-insulated garment helps the diver surpass the performance and acceptable duration constraints imposed by conventional drysuits or wetsuits and allows easy adjustments to the level of thermal comfort required by the diver. It additionally reduces the inherent buoyant forces associated with conventional drysuits and wetsuits, and provides uniform thermal protection over the entire surface of the diver's body since it is tailored to fit the diver. Furthermore, the liquid-insulated garment is not only useful to enhance the effectiveness of diving operations, but also in other places where additional thermal protection is needed.

10 Claims, 3 Drawing Sheets

LIQUID-INSULATED GARMENT FOR COLD WATER DIVING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to an improvement for diving suits. In particular, this invention relates to a liquid-insulated garment for diving suits that supplements the thermal protection of diving suits with liquids having low thermal conductivities.

Divers working in extremely cold water are limited in the amount of work they can perform before fatigue and impairment set in, and the length of time that they can stay in the water. Diving suits have been used that warm a diver with an active heating system, for example, electrically heated drysuits and hot-water suits. However, for one reason or another, such as logistics and availability, many diving operations cannot be supported with the active systems. As a result, passive systems and methods must be relied upon by divers to accomplish the task.

All passive systems and methods for protecting a diver from extreme cold water exposures share one common advantage over their active heating alternatives; that is, there is no requirement for energy storage or energy distribution. This advantage makes passive thermal protection garments appealing since they are less complex, more reliable, and usually less expensive.

Unfortunately, in extremely cold waters, passive systems customarily have required that divers reduce the loss of body heat to the surrounding cold water by wearing thick, layered insulating garments beneath waterproof diving suits. These layered suits tended to be excessively bulky and inhibited the diver's mobility, and they were also inherently buoyant and required 40–60 pounds of lead weights to make the diver neutrally buoyant. In addition, the layered suits were difficult to keep waterproof and created an uncertainty that could fatally reduce the diver's thermal protection during long duration missions. Lastly, these suits were only minimally effective in protecting the diver's extremities. Consequently, even the best conventional drysuits have been found to be inadequate to meet the full requirements for long duration missions in near freezing waters.

Conventional passive drysuits use foam or micro-fibrous batts beneath lightweight, waterproof shells. The inherent thermal protection value of these garments depends directly on the amount of entrapped air contained within these insulation batts. For long duration, cold missions, the insulation thicknesses necessary to protect the diver are excessive. Often, a diver must make long transits in a free-flooding submersible while the diver is at low metabolic levels. The diving garments are made to be excessively bulky to provide sufficient warmth for these trips. After the transit is over, however, these bulky garments usually are too buoyant for subsequent swimming scenarios. Additionally, as the diver enters the water, air bubbles entrapped in the bulky layers migrate to the upper regions of the drysuit. These trapped bubbles apply pressure around the diver's neck and shoulders, while leaving very little air in the lower extremities. This creates a "squeeze" in the lower suit and results in greatly reduced thermal protection in the legs, feet and hands.

This upward air bubble migration in conventional drysuits is due to the difference in densities between the entrapped air in the suit and the surrounding seawater. This migration of bubbles is similar to the workings of the forces that cause lift in a hot air balloon. A hot air balloon rises due to the relatively low density of the warm air in the balloon as compared to the surrounding sky. In like manner, the entrapped air in the drysuit rises to the highest possible levels in the suit, resulting in a wide variation in the level of thermal protection throughout the suit.

From the foregoing, it is clear that conventional drysuits have several deficiencies. Namely, they have insufficient thermal protection for long, cold missions; they are excessively bulky and hinder mobility; they are excessively buoyant to produce an acceptable degree of thermal protection and can create squeeze in the lower extremities of the suit to reduce thermal protection in lower extremities.

Thus, in accordance with this inventive concept, a need has been recognized in the state of the art for a liquid-insulated garment for diving suits that supplements the thermal protection of diving suits with liquids having low thermal conductivities.

SUMMARY OF THE INVENTION

The present invention is directed to providing an improvement for a diving suit that provides thermal protection. A liquid-insulated garment has a layer of liquid having substantially the same density as water and thermal conductivity of less than 0.070 Btu/ft-hr-° F. to provide insulation from ambient cold.

An object of the invention is to provide thermal protection for a diver.

Another object of the invention is to provide a diver garment that supplements the inherent thermal protection value of traditional suit insulations with liquids having low thermal conductivities.

Another object of the invention is to provide a supplemental source of thermal protection for divers wearing passively-insulated wetsuits or drysuits to prolong acceptable durations for operations and missions in cold water.

Another object of the invention is to provide a liquid-insulated garment that helps surpass the performance and acceptable durations of conventional drysuits or wetsuits to cold and allows easy adjustments to the level of thermal comfort required by a diver.

An object of the invention is to provide a liquid-insulated garment that reduces the inherent buoyant forces associated with conventional drysuits and wetsuits, and provides uniform thermal protection over the entire surface of the diver's body.

Another object of the invention is to provide a liquid-insulated garment consisting of a liner, worn either inside or outside a diving suit, which is inflated with a low heat conducting liquid having a liquid density that is approximately the same as the surrounding seawater.

Another object of the invention is to provide a liquid-insulated garment having a means for removing the liquid insulation before the swim portion of a mission.

Another object of the invention is to provide a liquid-insulated garment that minimizes suit squeeze in the lower extremities to give uniform insulation over the entire body of the diver.

Another object of the invention is to provide a liquid-insulated garment that minimizes suit buoyancy by using insulating liquids having specific gravities that are approximately the same as seawater.

Another object of the invention is to provide a liquid-insulated garment that minimizes bulk of a diving suit that is normally associated with fibrous batt insulations.

Another object of the invention is to provide a liquid-insulated garment that provides a means to easily change the suit insulation value by simply adding, or removing, liquids.

These and other objects of the invention will become more readily apparent from the ensuing specification when taken in conjunction with the appended claims.

DESCRIPTION OF THE PREFERRED EMBODIMENT

Figure 1:
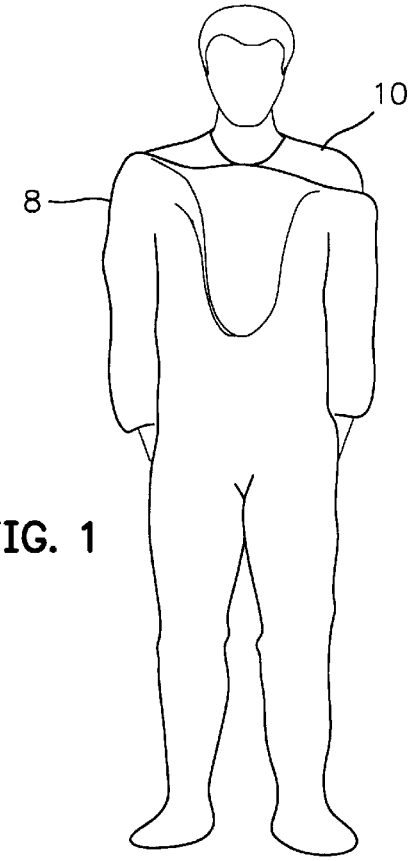
FIG. 1 is a schematic drawing of a diver suiting-up in a drysuit over the liquid-insulated garment of this invention.

Referring to FIG. 1 of the drawings, a diver is shown before a dive while suiting-up in drysuit 8. Before drysuit 8 is put on, however, the diver dons form-fitting liquid-insulated garment 10 of this invention. Liquid-insulated garment 10 has a flexible liner 11 that is designed to be worn next to the body and cover it much like a pair of close fitting long underwear. This liner 11 might preferably also be elastic so that it snugly fits while the diver bends and stretches performing the arduous tasks associated with diving operations. Neoprene, lycra, or sheet rubber might be suitable materials for liner 11 and it is tailored to conform to the diver's body.

Figure 2:
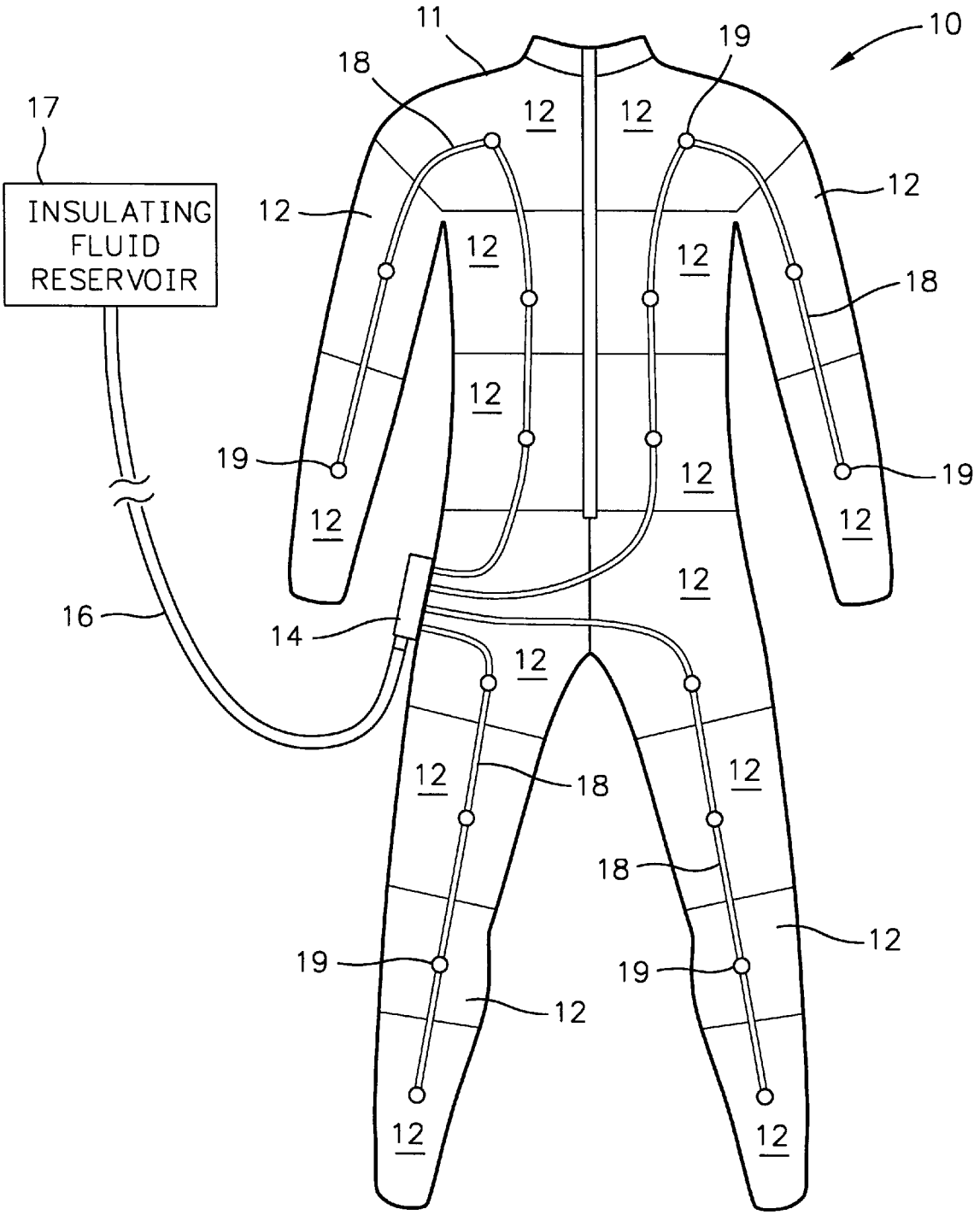
FIG. 2 is a schematic drawing of a front view of liquid-insulated garment and its interconnected liquid manifold.

This body-hugging feature of liquid-insulated garment 10 also provides for a close fit inside a diving suit, such as a passive drysuit or a wetsuit. Liquid-insulated garment 10 is fashioned not only to fit snugly on the diver but it also is structurally strong enough to support and position a plurality of flat bladders 12 adjacent the diver's body, see FIG. 2.

Flat bladders 12 are flexible, flat bag-shaped containers that are secured to the material of liner 11 by any of many well-known fastening means such as resilient bonding agents, mating strips of the fastener sold under the trademark VELCRO, etc. The plurality of bladders 12 depicted are differently configured to extend over and conform to the differently shaped areas of the body. Bladders 12 contain low heat conducting, or insulating liquid 13 during determinable periods during diving operations. The coverage of liquid 13 in bladders 12 thermally protects the various muscle groups and organs of the body to improve metabolism and thereby directly affect the performance of tasks.

Manifold 14 is secured to liner 11 and interconnects liquid-insulated garment 10 to hose 16. Hose 16 extends to a remote reservoir 17 of insulating liquid 13 that may be heated, if needed. Manifold 14 has the necessary passageways to distribute and gather insulating liquid 13 to and from bladders 12 via several tubes 18 that are coupled to bladders 12 through appropriate fittings 19. The selective two-way flow of insulating liquid 13 may be initiated at reservoir 17 of insulating liquid 13 for the reasons to be explained below.

Figure 3:
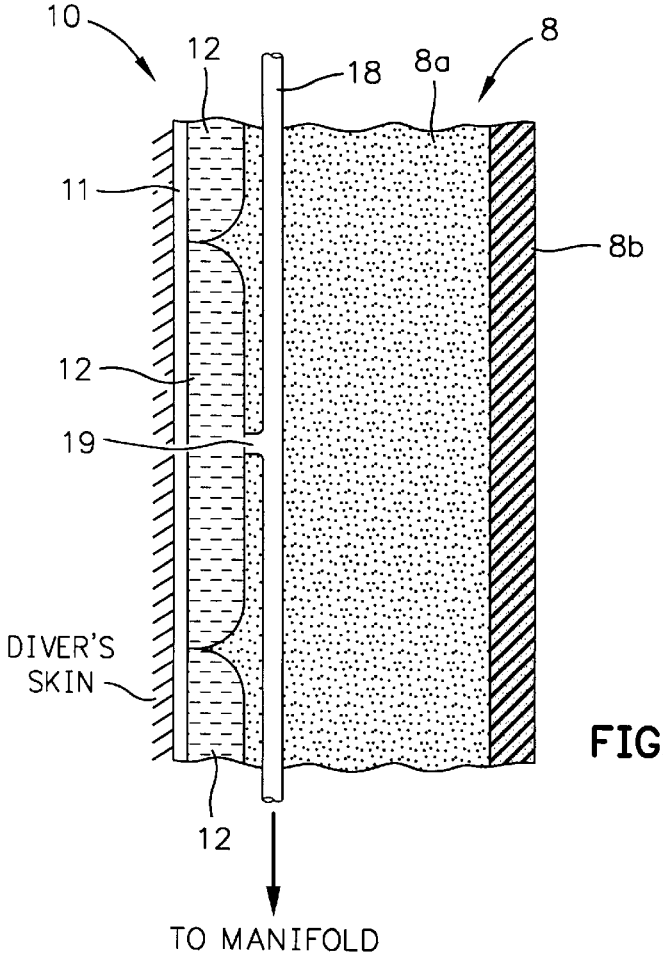
FIG. 3 is a cross-sectional representation of the liquid-insulated garment next to a diver's skin inside a drysuit.

Looking to FIG. 3, liquid-insulated garment 10 is intended to be worn inside the diving suit with either liner 11 or bladders 12 being worn next to the diver's skin, although a diver may wear it outside the suit. Liquid-insulated garment 10 is shown inside the suit to augment the thermal protection of conventional fibrous, or batt material 8*a* and resilient outer layer 8*b* of dive suit 8. In the case of suit 8 being a wetsuit, liquid-insulated garment 10 is worn next to the inside or outside of the resilient layer. Irrespective where it is worn, liquid-insulated garment 10 increases thermal protection due to the low heat conducting, or insulating liquid 13 that is contained in bladders 12.

Liquid-insulated garment 10 of this invention increases thermal protection of a conventional wetsuit or drysuit. This increased thermal protection is due to filling bladders 12 with low heat conducting liquid 13 having a liquid density that is approximately the same as the surrounding seawater. Food-quality oils having thermal properties approaching those for some insulating foams, and densities near that of water have been identified as potential liquid insulating mediums. See the article, by Nuckols, M. L. and Courson, B. F., entitled "Passive Methods of Thermal Protection for Cold Water Diving", *Proceedings of Underwater Intervention* '94, Marine Technology Society, Feb. 7–10 1994, San Diego, Calif., and the article by Nuckols, M. L., Lippitt, M. W., and Dudinsky, J., entitled "The Liquid-Filled Suit-Intersuit Concept; Passive Thermal Protection for Divers", *J. of Undersea Biomedical Research*, Vol. 1 8, No 3, 1991, pp 168–172.

This composite suit including liquid-insulated garment 10 of this invention results in added insulation for a diving suit without additional buoyancy, and minimizes the loss of insulation in the extremities otherwise caused by lower suit squeeze. In addition, garment 10 requires no active heating and minimal energy storage requirements. Analytical investigations and laboratory testing indicates that acceptable mission durations in free-flooding submersibles can be extended by up to 2½ times the acceptable mission durations for conventional drysuits when the layer thickness of low heat conducting, or insulating liquid 13 is only 0.25 of an inch.

While providing improved insulation for divers is the primary concern of this invention, liquid-insulated garment 10 also is designed to assure improved mobility for the diver. Since existing drysuits already tend to hinder the diver's range of motion, any added insulation must not degrade diver mobility. Liquid-insulated garment 10 achieves this goal by providing hose 16, manifold 14, tubes 18, and fittings 19 for removing liquid insulation 13 from bladders 12 prior to the swim portion of a mission.

Bladders 12 are supplied with the appropriate amount of insulating liquid 13 by way of hose 16, manifold 14, tubes 18, and fittings 19 that distributes insulating liquid 13 to bladders 12 covering different regions of the diver's body. This is similar to the water distribution system within a non-return hot-water suit. Manifold 14,could include a quick disconnect fitting that gives the diver access to insulating liquid 13 in reservoir 17 as required.

During the swimming phase of a mission when the diver's metabolic heat production is elevated and greater mobility is required, insulating liquids 13 are drained, or pumped, from bladders 12 of liquid-insulated garment 10 to maximize the diver's ability to swim in drysuit 8. By storing insulating liquid 13 in reservoir 17 that is located aboard a free-flooding submersible used during the transit phase of a mission, the diver may vary suit insulations without affecting suit, or submersible, buoyancy. When the diver returns to the submersible after the completion of the swim phase of the mission, the diver re-inflates bladders 12 of garment 10 with the stored liquid 13 from reservoir 17. This gains an added measure of thermal protection for the diver during the return transit in the submersible.

Liquid-insulated garment 10 and the storage procedure associated with insulating liquid 13 in reservoir 17 could also be beneficially relied upon during extended decompressions in the water for deep salvage missions. As the diver rests during a decompression stage, drysuit 8 could be "inflated" with insulating liquid 13 from reservoir 17, which may be heated by a small submersible heater.

Figure 4:
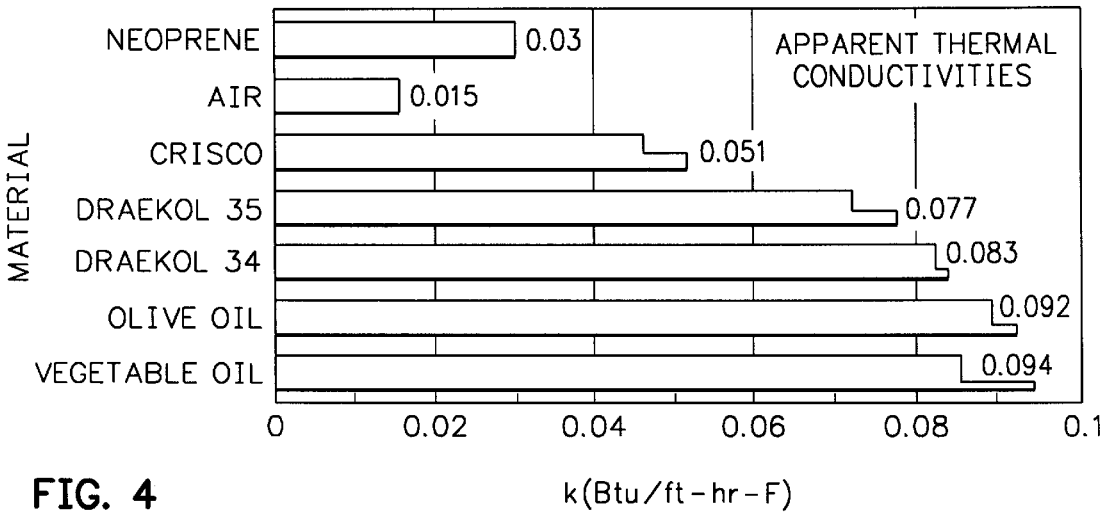
FIG. 4 is a graph of materials having low thermal conductivities for inclusion in the liquid-insulated garment.

A number of commercially available, thermally insulating liquids are, at least, potential candidates for the low heat conducting, or insulating liquid 13 of liquid-insulated garment 10. Each liquid 13 is determined to be acceptable based on thermal conductivity, viscosity, specific gravity, toxicity and expected compatibilities with conventional drysuit and wetsuit materials, Ideally, candidate liquids should have low thermal conductivities of less that 0.070 Btu/ft-hr-° F., densities approximately equal to that of water (specific gravity equal to 1.0) and non-toxic (food quality). Laboratory testing has included common cooking oils, available at any grocery store, having specific gravities of approximately 0.87 at 70° F. Also tested were Draekol™ liquids. Draekol™ is a registered trademark for white mineral oils manufactured by Penreco, a division of Pennzoil Products Company in Karns City, Pa. and is characterized by white mineral oils having specific gravities ranging between 0.86 and 0.88. These liquids meet FDA regulations covering direct use in foods. See FIG. 4 which compares the insulation potentials of candidate materials.

In addition, Crisco™ vegetable shortening has been identified as an acceptable candidate. Although Crisco™ is not a liquid at normal room temperatures, it does meet many of the other design goals related to food quality and density set for the liquid candidates. Furthermore, this material most closely simulates the layer of fat present in most marine mammals. In effect, this layer of simulated "blubber" in a diver's suit could potentially protect divers in a similar manner as the naturally occurring protection found in these marine mammals.

From the foregoing, it is seen that liquid-insulated garment 10 of this invention is particularly applicable to liquid-insulated drysuits, or wetsuits, worn during long, cold water missions. These missions frequently require that the diver spends lengthy intervals at minimal activity, such as in transit in a wet submersible or during lengthy decompression stops in the water. The application of insulating liquids 13 to drysuits is most desirable when they can be used with the system hereindescribed that allows liquids 13 to be easily removed and added as the diver's activity level changes. The existing thermal protection afforded by current drysuits is inadequate for protecting divers in 32° F. water for missions longer than 2 hours. Including liquid-insulated garment 10, whose bladders 12 on liner 11 have been inflated with liquid 13 to create a 0.375-inch thick liquid layer, gives conventional drysuit 8 an estimated, improved acceptable mission duration at this water temperature to over 6 hours. In addition, liquid-insulated garment 10 minimizes suit squeeze in the lower extremities by giving uniform insulation over the entire body of the diver, minimizes suit buoyancy by using insulating liquids 13 having specific gravities approximately the same as seawater, minimizes suit bulk normally associated with fibrous batt insulations, and provides a means to easily change the suit insulation value by simply adding, or removing, different amounts of insulating liquids 13.

Figure 5:
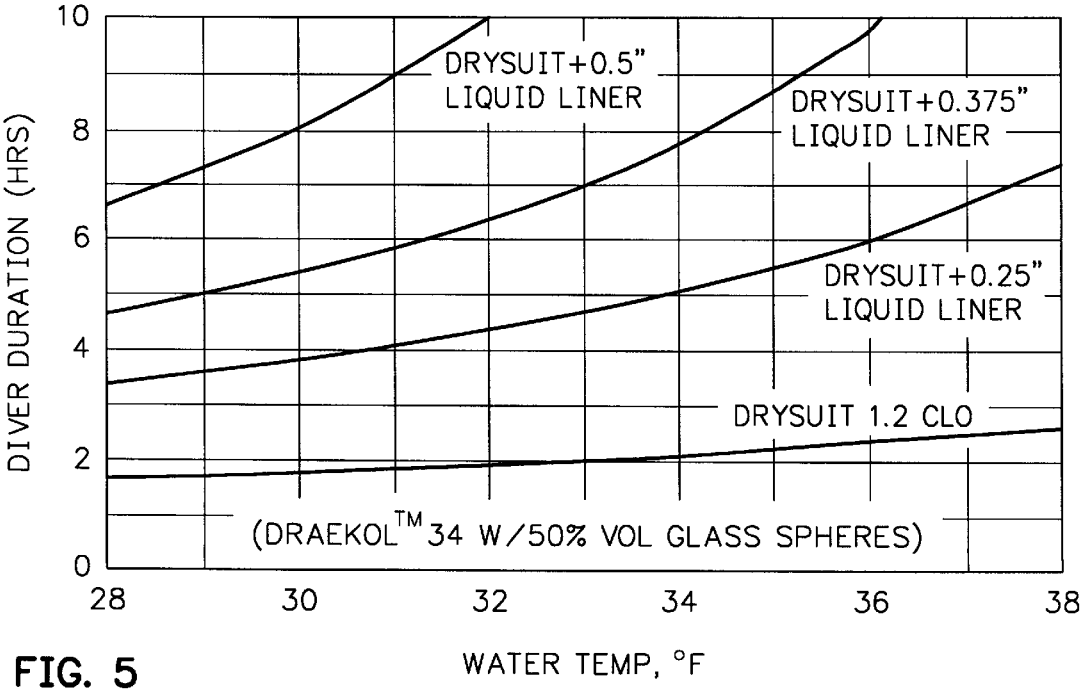
FIG. 5 is a graph showing effectiveness of different thicknesses of liquid liners containing hollow glass microspheres in bladders in the liquid-insulated garment.

Modification of liquid-insulated garment 10 can be made by adding preselected amounts of hollow glass micro-spheres to insulating liquid 13. Hollow glass micro-spheres, tiny hollow balls of glass that encapsulate air, have been shown to enhance the insulation properties of liquids 13, although the hollow glass micro-spheres reduce the specific gravities of liquids 13. Typical hollow glass micro-spheres could be the hollow glass micro-spheres known as K25 Scotchlite™ microspheres manufactured by 3M Corporation of St. Paul, Minn. FIG. 5 gives predicted durations for safe, cold water exposures by a diver when the bladders 12 of liquid-insulated garment 10 are inflated to various thicknesses of liquid 13. Observe that acceptable exposures in 32° F. water in excess of 6 hours can be achieved with liquid-insulated garment 10 when bladders 12 are inflated with ⅜ of an inch thickness of a white mineral oil (Draekol 34) mixed with glass micro-spheres at 50% by volume (a mixture having a measured thermal conductivity of 0.062 Btu/ft-hr-° F.). By adding 50% volume of these glass microspheres, the conductivity of Draekol 34 was dropped by 25%. Similar reductions in thermal conductivities result by adding predetermined amounts of microspheres to other insulating liquids to bring the composite thermal conductivities to less than 0.070 Btu/ft-hr-° F.

Liquid-insulated garment 10 supplements the inherent thermal protection value of traditional suit insulations with bladders 12 containing insulating liquids 13 having low thermal conductivities. Liquid-insulated garment 10 helps a diver surpass the performance and acceptable duration constraints imposed by conventional drysuits or wetsuits and allows easy adjustments to the level of thermal comfort required by the diver. It additionally reduces the inherent buoyant forces associated with conventional drysuits and wetsuits, and provides uniform thermal protection over the entire surface of the diver's body. Furthermore, while liquid-insulated garment 10 has been described as being useful to enhance the effectiveness of diving operations, garment 10 could also be useful wherever additional thermal protection is needed.

It should be readily understood that many modifications and variations of the present invention are possible within the purview of the claimed invention. It is therefore to be understood that within the scope of the appended claims the invention may be practiced otherwise than as specifically described.

We claim:

1. A liquid-insulated garment comprising a layer of insulating liquid contained in at least one bladder, said liquid having substantially the same density as water and thermal conductivity of less than 0.070 Btu/ft-hr-° F. to provide insulation from ambient cold.

2. A garment according to claim 1 further including:

a flexible liner conforming to at least part of the body; and a plurality of bladders containing said insulating liquid on said liner, said bladders of said insulating liquid being located to cover muscle groups of a diver.

3. A garment according to claim 2 in which said liner is elastic to form-fit said diver and said bladders are secured to said liner.

4. A garment according to claim 3 in which said bladders are flexible plastic bags containing said insulating liquid.

5. A garment according to claim 4 further including:

a reservoir of said insulating liquid;

a manifold carried on said diver connected to said reservoir by a hose;

tubing extending from said manifold to said bladders, said manifold and said tubing permitting selective transfer of said insulating liquid to and from said bladders.

6. A garment according to claims 1, 2, 3, or 4 in which said insulating liquid is selected from the group consisting of white mineral oil, Crisco™, and other liquids having thermal conductivities less than 0.070 Btu/ft-hr-° F.

7. A garment according to claim 6 further including:

hollow glass micro-spheres in said insulating liquid in said bladders.

8. An apparatus according to claim 6 in which said bladders are inflatable by said insulating liquid to produce a layer of said insulating liquid having a thickness up to 0.5 of an inch.

9. An apparatus according to claim 7 in which said bladders are inflatable by said insulating liquid to produce a layer of said insulating liquid having a thickness up to 0.5 of an inch.

10. An apparatus according to claim 5 further including:

a heater to heat said insulating liquid in said reservoir.

* * * * *